US011236463B2

(12) United States Patent
Lai

(10) Patent No.: US 11,236,463 B2
(45) Date of Patent: Feb. 1, 2022

(54) FABRIC STEAMER

(71) Applicant: CONAIR CORPORATION, Stamford, CT (US)

(72) Inventor: Kin Man Lai, Hong Kong (HK)

(73) Assignee: Conair LLC, Stamford, CT (US)

( * ) Notice: Subject to any disclaimer, the term of this patent is extended or adjusted under 35 U.S.C. 154(b) by 80 days.

(21) Appl. No.: 16/690,894

(22) Filed: Nov. 21, 2019

(65) Prior Publication Data

US 2021/0156076 A1 May 27, 2021

(51) Int. Cl.
*D06F 73/00* (2006.01)
*D06F 75/20* (2006.01)

(52) U.S. Cl.
CPC ..... *D06F 73/00* (2013.01); *D06F 75/20* (2013.01)

(58) Field of Classification Search
CPC ..... D07F 73/00; D07F 75/20; D07F 75/06; D07F 75/10; D07F 75/14; D07F 75/16; D07F 75/18; D07F 75/22
See application file for complete search history.

(56) References Cited

U.S. PATENT DOCUMENTS 2,027,767 A * 1/1936 Deems ..... D06F 75/16 38/77.83
D106,361 S 10/1937 Von Schrader
2,797,507 A * 7/1957 Maykemper ..... D06F 75/18 38/77.83
D222,502 S 10/1971 Madl
3,620,055 A 11/1971 Blachly et al.
3,646,317 A 2/1972 Osrow
D229,016 S 11/1973 Plasko
D229,664 S 12/1973 Stutzer
3,889,406 A * 6/1975 Chivers ..... A47L 13/225 38/77.83

(Continued)

FOREIGN PATENT DOCUMENTS

CN 202739105 U * 2/2013

OTHER PUBLICATIONS

International Search Report dated Feb. 4, 2021 from corresponding International Patent Application No. PCT/2020/059269, 2 pages.

(Continued)

*Primary Examiner* — Ismael Izaguirre
(74) *Attorney, Agent, or Firm* — Ohlandt, Greeley, Ruggiero & Perle, L.L.P.

(57) ABSTRACT

A handheld appliance for emitting steam to treat a fabric has a housing, a water reservoir, a pump, and a steam generator operatively connected to the pump. The housing has an annular steam emitting head having a hole passing through the steam head. The steam head has an outlet with a shape surrounding the hole so that steam inside the steam head is emitted out of the steam head through the outlet around the hole. A handheld appliance for emitting steam to treat a fabric also has a housing having a water reservoir, a pump, a steam generator operatively connected to the pump, and an outlet. The steam generator forms a steam path that has a first layer that extends from an inlet into the steam generator on a first side of a heater to a second layer that is on a second side of the heater opposite to the first layer.

14 Claims, 21 Drawing Sheets

(56) References Cited

U.S. PATENT DOCUMENTS

| | | | | |
|---|---|---|---|---|
| 3,947,659 | A * | 3/1976 | Ono | A45D 20/00 392/404 |
| 4,114,022 | A * | 9/1978 | Braulke, III | A45D 20/00 132/212 |
| D255,864 | S | 7/1980 | Bennett | |
| D262,257 | S | 12/1981 | Sohn | |
| 4,341,229 | A * | 7/1982 | Bauer | A45D 1/04 132/204 |
| 4,399,349 | A | 8/1983 | Deming et al. | |
| 4,496,826 | A | 1/1985 | Osrow | |
| 4,536,977 | A | 8/1985 | Doyel | |
| 4,571,483 | A | 2/1986 | Fathi | |
| 4,583,260 | A | 4/1986 | Zai | |
| D319,121 | S | 8/1991 | Muller | |
| 5,279,054 | A * | 1/1994 | Chasen | D06F 75/24 219/254 |
| 5,297,739 | A * | 3/1994 | Allen | A46B 17/06 239/530 |
| 5,630,287 | A * | 5/1997 | Shimosaka | D06F 75/18 38/77.3 |
| 5,651,201 | A | 7/1997 | Farley | |
| D426,924 | S | 6/2000 | Joiner et al. | |
| D436,424 | S | 1/2001 | Buzzi | |
| 6,275,653 | B1 | 8/2001 | Montipo' | |
| 6,986,217 | B2 | 1/2006 | Leung | |
| D516,759 | S | 3/2006 | Lam | |
| D525,399 | S | 7/2006 | Alday Lesaga | |
| D540,498 | S | 4/2007 | Tobias | |
| D542,488 | S | 5/2007 | Lee | |
| D576,363 | S | 9/2008 | Reiner | |
| 7,490,422 | B1 | 2/2009 | Chen | |
| D589,663 | S | 3/2009 | Massip | |
| D592,365 | S | 5/2009 | Massip | |
| D601,806 | S | 10/2009 | Choi | |
| 7,661,212 | B2 | 2/2010 | Hahn et al. | |
| D622,457 | S | 8/2010 | Choi | |
| D646,029 | S | 9/2011 | Choi | |
| D646,445 | S | 10/2011 | Choi | |
| D648,494 | S | 11/2011 | Vrdoljak | |
| D648,495 | S | 11/2011 | Ediger | |
| D648,908 | S | 11/2011 | Ediger | |
| D651,774 | S | 1/2012 | Tobias | |
| D670,876 | S | 11/2012 | Vrdoljak | |
| 8,893,410 | B2 | 11/2014 | Vrdoljak et al. | |
| D725,326 | S | 3/2015 | Spencer | |
| D731,723 | S | 6/2015 | Dammkoehler | |
| D776,887 | S | 1/2017 | Deffrennes | |
| 9,845,568 | B2 | 12/2017 | Fung | |
| D808,600 | S | 1/2018 | Malatray | |
| D826,492 | S | 8/2018 | Huang | |
| D842,559 | S | 3/2019 | Yang | |
| 10,309,053 | B2 * | 6/2019 | Yagi | D06F 75/18 |
| D857,313 | S | 8/2019 | Smith | |
| 10,385,503 | B2 * | 8/2019 | Lukas | D06F 75/24 |
| 10,570,560 | B2 | 2/2020 | Chua | |
| D894,506 | S | 8/2020 | Protet | |
| D906,606 | S | 12/2020 | Zeng | |
| 2004/0010950 | A1 | 1/2004 | Leung et al. | |
| 2006/0018638 | A1 | 1/2006 | Leung | |
| 2010/0024492 | A1 | 2/2010 | Leung | |
| 2010/0269287 | A1 | 10/2010 | Vrodljak et al. | |
| 2013/0111777 | A1 * | 5/2013 | Jeong | A45D 20/12 34/97 |
| 2013/0232713 | A1 | 9/2013 | Luedke et al. | |
| 2015/0082839 | A1 * | 3/2015 | Holm | D06F 73/00 68/5 R |
| 2015/0128664 | A1 | 5/2015 | Date et al. | |
| 2015/0354128 | A1 | 12/2015 | Choo et al. | |
| 2016/0053430 | A1 | 2/2016 | Chua et al. | |
| 2016/0160434 | A1 | 6/2016 | Chua et al. | |
| 2016/0168778 | A1 | 6/2016 | Wadhwa et al. | |
| 2016/0194816 | A1 | 7/2016 | Chua et al. | |
| 2017/0260685 | A1 | 9/2017 | Fung | |
| 2018/0142883 | A1 | 5/2018 | Wadhwa et al. | |
| 2018/0371684 | A1 | 12/2018 | Ong et al. | |
| 2020/0362505 | A1 | 11/2020 | Razouki | |

OTHER PUBLICATIONS

Written Opinion dated Feb. 4, 2021 from corresponding International Patent Application No. PCT/2020/059269, 5 pages.

Handheld Fabric Steamer; https://www.walmart.com/ip.Conair-ExtremeSteam-Hand-Held-Fabric-Steamer-with-Dual-Heat-White-Blue-Model-GS237/588827857 (Year: 2016).

* cited by examiner

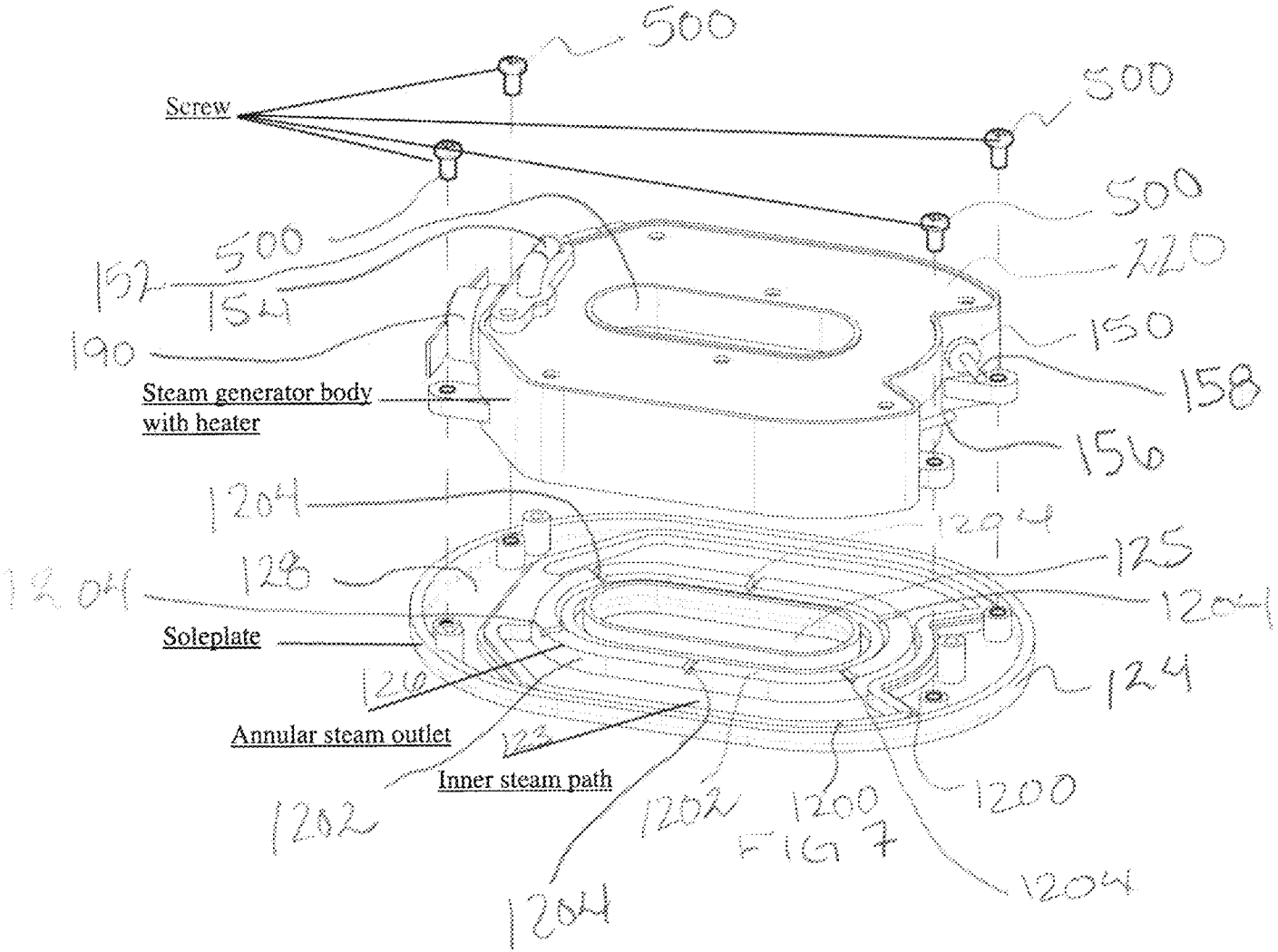
Screw
Steam generator body with heater
Soleplate
Annular steam outlet
Inner steam path
500
500
500
500
120
150
158
156
154
190
192
125
124
126
128
122
1200
1202
1204
1204
1204

Section B-B

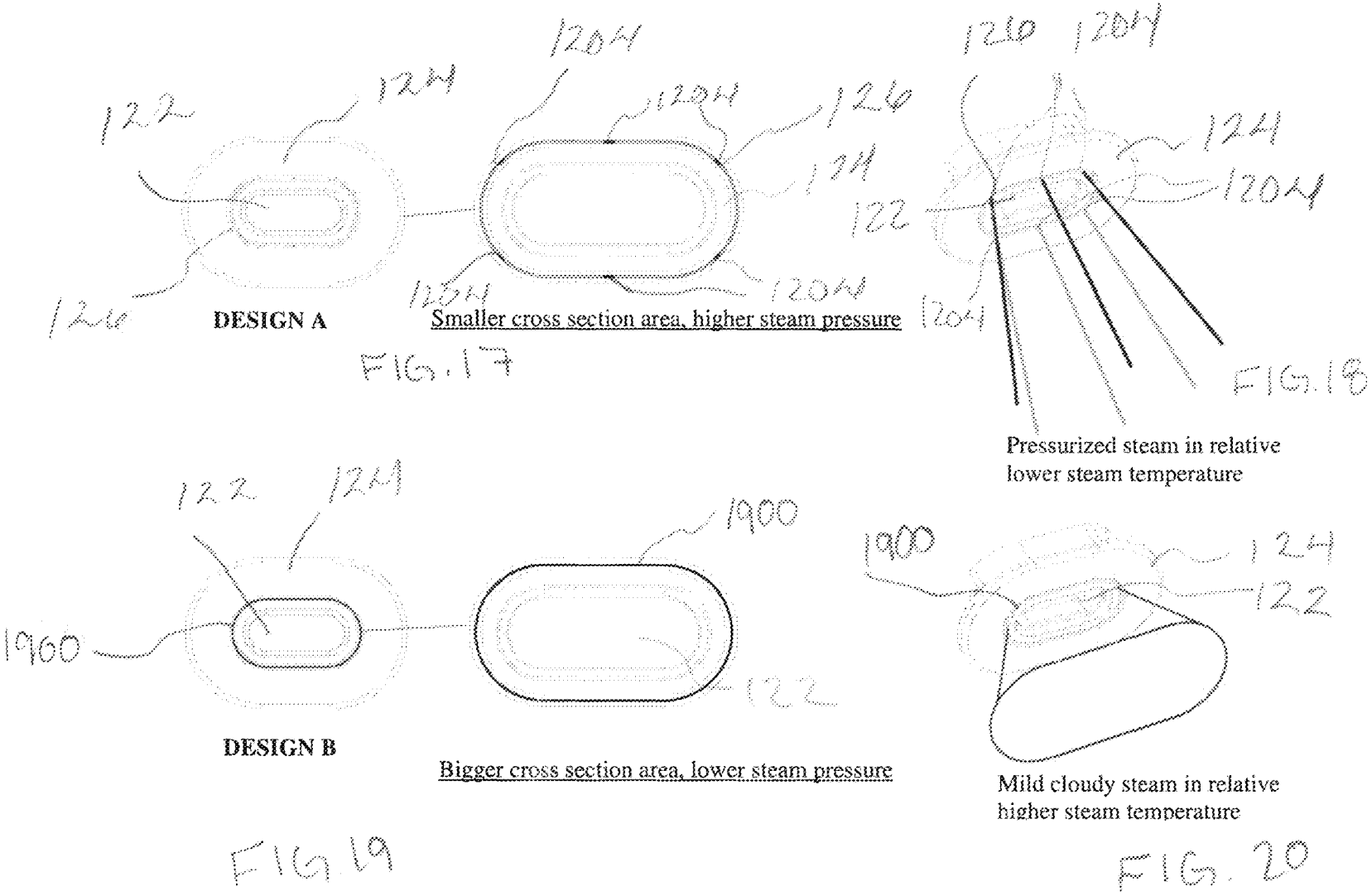
122
124
DESIGN A
124
124
124
122
124
124
124

Close to the Centre hole (Original)

At the middle of soleplate area (Alternative 1)

Close to the outer housing area (Alternative 2)

Horizontal steam ironing

FABRIC STEAMER

BACKGROUND OF THE DISCLOSURE

1. Field of the Disclosure

The present disclosure is directed to a fabric steamer. More particularly, the present disclosure relates to a hand-held fabric steamer having a hole through a steam head and an outlet surrounding the hole. In addition, the present disclosure relates to a fabric steamer having a steam generator having a layered water path.

2. Description of the Related Art

Handheld appliances for applying steam to remove wrinkles from, to clean, and to deodorize fabrics, such as clothing garments, draperies, upholstery, and other items, are generally known. In such appliances, water is placed in a reservoir and heated to produce steam and that steam is emitted through a nozzle or steam outlet that a user directs toward the fabric.

One typical appliance has a steam outlet that includes a group of holes that each have a dot shape. During use, the appliance is moved along the fabric such that each dot shaped hole moves along a path that forms a line. This path can undesirably result in a line mark on the fabric.

Another typical appliance has a steam outlet that has a straight line shape. The straight line shape does not form the line mark on the fabric that can result from the steam outlet that includes a group of holes each with a dot shape. This outlet having the straight line shape provides more efficient steam ironing than the steam outlet that includes a group of holes that each have a dot shape.

However, there remains a need for improving the steam ironing coverage area and/or steam ironing efficiency.

SUMMARY

The present disclosure provides a hand-held fabric steamer having a hole in a middle of an annular steam head.

The present disclosure also provides such a fabric steamer that has a wide footprint/spray pattern achieved by an annular formation of holes.

The present disclosure further provides such a fabric steamer that also has a reduced internal volume due to the hole in the middle of the annular steam head that results in high pressure steam (as opposed to a larger volume cavity).

The present disclosure yet further provides that the fabric steamer having the annular steam head also provides a Venturi effect of surrounding air being drawing through the hole and the ability to visually watch through the hole during use.

In an embodiment of the present disclosure, a handheld appliance for emitting steam to treat a fabric is provided having a housing, a water reservoir, a pump, and a steam generator operatively connected to the pump. The housing has a steam head and a hole through the steam head. The steam head is hollow surrounding the hole. The steam head has an outlet that has a shape surrounding the hole so that steam inside the steam head is emitted out of the steam head through the outlet around the hole.

In another embodiment of the present disclosure, a hand-held appliance for emitting steam to treat a fabric is also provided having a housing having a water reservoir, a pump, a steam generator operatively connected to the pump, and an outlet. The steam generator forms a steam path that heats water into steam. The steam path has a first layer that extends from an inlet into the steam generator on a first side of a heater to a second layer that is on a second side of the heater opposite to the first layer.

The above and other objects, features, and advantages of the present invention will be apparent and understood by those skilled in the art from the following detailed description, drawings, and accompanying claims. As shown throughout the drawings, like reference numerals designate like or corresponding parts.

BRIEF DESCRIPTION OF THE DRAWINGS

FIG. 7 is a side perspective view of a soleplate separated from a steam generator body and screws of the steam generator shown in FIG. 5.

FIG. 9 is schematic illustration of the water tank of FIG. 8 being filled with water.

FIG. 17 is a front view of the steam generator of FIG. 5 and an enlarged front view of an outlet.

FIG. 18 is a front perspective view of the steam generator of FIG. 5 that schematically illustrates the steam output of the fabric steamer of FIG. 1.

FIG. 19 is a front view of the steam generator of FIG. 5 having an outlet that is an alternative to the outlet of FIG. 17 and an enlarged front view of the alternative outlet.

FIG. 20 is a front perspective view of the steam generator of FIG. 5 that schematically illustrates the steam output of the alternative outlet of FIG. 19.

FIG. 28 is schematic illustration of the fabric steamer of FIG. 1 that is horizontally steam ironing.

DETAILED DESCRIPTION OF THE DISCLOSURE

Figures 1, 2:
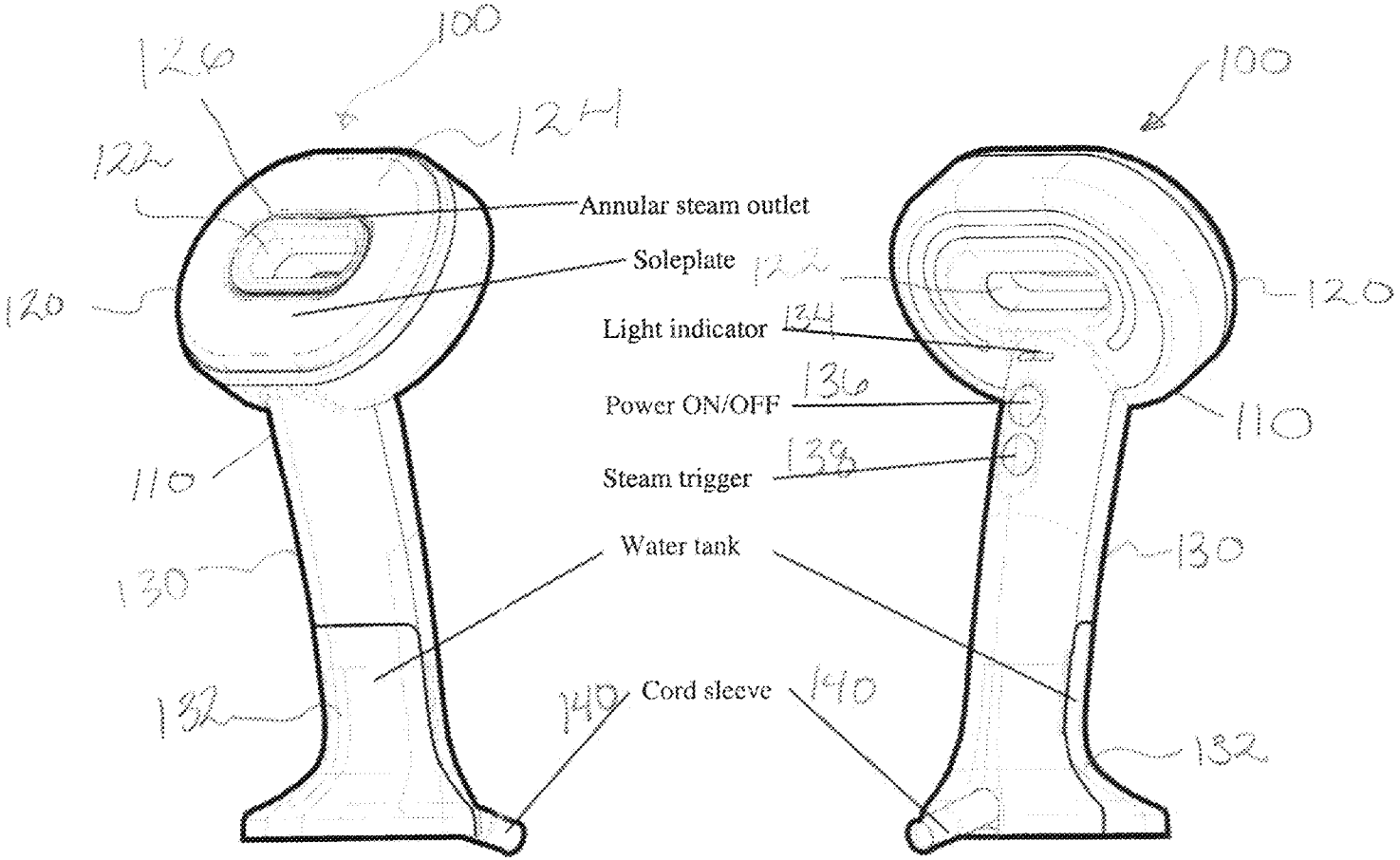
FIG. 1 is a front perspective view of a fabric steamer according to the present disclosure.
FIG. 2 is a rear perspective view of the fabric steamer of FIG. 1.

A fabric steamer 100 according to the present disclosure is shown in FIGS. 1 and 2. Fabric steamer 100 applies steam to remove wrinkles from, to clean, and to deodorize fabrics, such as clothing garments, draperies, upholstery, and other items.

Fabric steamer 100 has a housing 110. Housing 110 has an annular steam head 120 that is an annular shape forming a hole 122 through housing 110. Annular steam head 120 has a soleplate 124 that forms a portion of housing 110. Housing 110 has an outlet 126 through soleplate 124 that is an annular shape to surround hole 122.

Housing 110 has a handle portion 130 that extends from annular steam head 120. Handle portion 130 has a removeable water tank 132, light indicator 134, power button 136, steam trigger 138 and cord sleeve 140. Light indicator 134 is a LED or other illuminating device. Cord sleeve 140 surrounds a power cord to supply power to fabric steamer 100 from a power supply, for example, an electrical outlet. A user can press power button 136 to selectively connect and disconnect power from the power source to fabric steamer 100. The user can press steam trigger 138 to selectively commence emitting steam and stop emitting steam from fabric steamer 100. Water tank 132 is selectively removeable from the remainder of fabric steamer 100. Water tank 132 and housing 110 when connected are shaped to form a stand that supports fabric steamer 100 to rest on a horizontal surface and maintain a vertical orientation as shown in FIGS. 1 and 2.

Soleplate 124 is, preferably, made of a metallic material or other suitable material having heat conductivity properties. A portion of housing 110, other than soleplate 124, is made of any sufficiently rigid material such as, for example, any of the plastic materials generally used for handheld garment steamer products.

Figure 3:
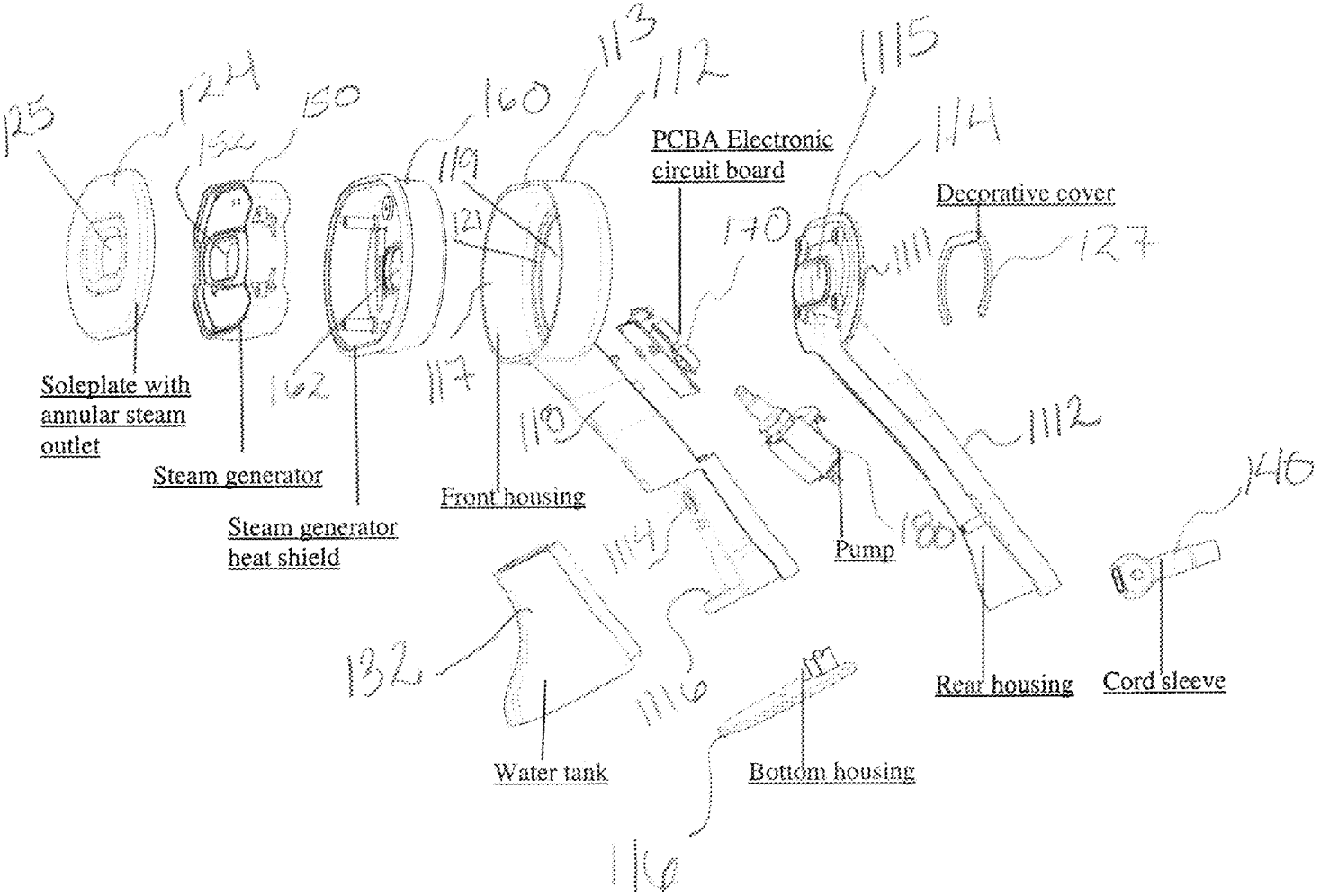
FIG. 3 is an exploded view of the components of the fabric steamer of FIG. 1.

Referring to FIG. 3, besides soleplate 124, housing 110 has a steam generator heat shield 160, a front housing 112, a rear housing 114 and a bottom housing 116. Soleplate 124 has a hole 125. Front housing 112 has a front steam head portion 113 and a front handle portion 118. Front steam head portion 113 forms a sidewall 117. Sidewall 117 is open on a first side and has a hole 119 through a rear wall 121 on a second side that is opposite the first side. Rear housing 114 has a rear steam head portion 1111 and a rear handle portion 1112. Rear steam head portion 1111 has hole 1115. A decorative cover 127 is connectable to rear housing 114 to surround hole 1115.

Fabric steamer 100 further has a water tank 132, cord sleeve 140, a steam generator 150, a printed circuit board assembly 170 and a pump 180. Steam generator 150 has a complementary shape to annular steam head 120 so that a hole 152 is formed in steam generator 150. Steam generator 150 is made of a metal die-cast with embedded heater 240 (FIG. 4) and mounted with thermal control. Steam generator heat shield 160 also has a complementary shape to annular steam head 120 so that a hole 162 is formed in steam generator heat shield 160. Water tank 132 has a shape to mate with front handle portion 118.

Figure 4:
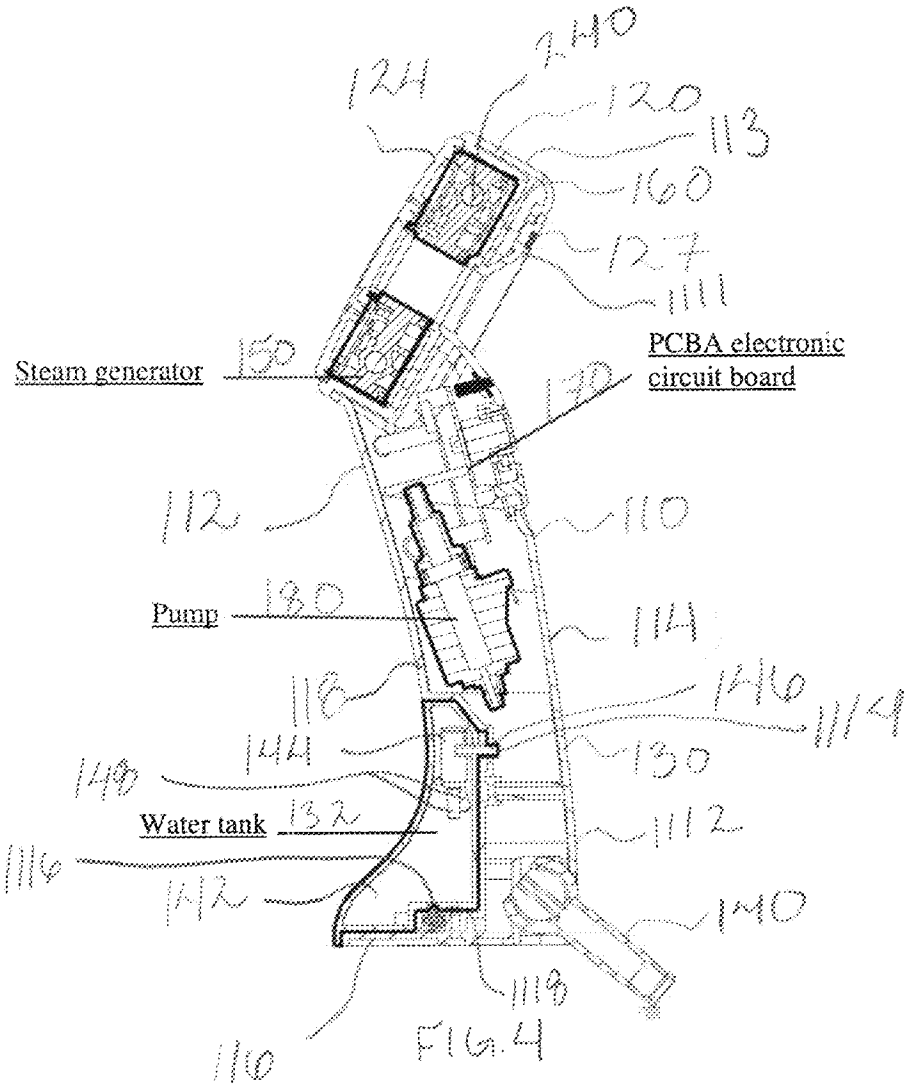
FIG. 4 is a side cross-sectional view of the fabric steamer of FIG. 1.

Referring to FIG. 4, housing 110 is formed by soleplate 124, steam generator heat shield 160, front housing 112, rear housing 114 and bottom housing 116. Soleplate 124 is connected to steam generator heat shield 160 by snap fit, screws or other attachment assembly. Steam generator 150 is positioned inside soleplate 124 and steam generator heat shield 160. Steam generator heat shield 160 is connected to rear housing 114 also by snap fit, screws or other attachment assembly. Front steam head portion 113 of front housing 112 is secured between steam generator heat shield 160 and rear housing 114. Hole 125 of soleplate 124, hole 119 of front housing 112, hole 1115 of rear housing 114, hole 152 of steam generator 150 and hole 162 of steam generator heat shield 160 are all aligned to form hole 122 when assembled. Decorative cover 127 is connected to exterior of rear housing 114 also by snap fit, screws or other attachment assembly.

Handle portion 130 is formed by front handle portion 118 of front housing 112 that is connected to rear handle portion 1112 of rear housing 114 also by snap fit, screws or other attachment assembly. Printed circuit board assembly 170 and pump 180 are positioned in handle portion 130. Front housing 112 and rear housing 114 form supports to maintain printed circuit board assembly 170 and pump 180 in place in housing 110. Water tank 132 is removably connected to front handle portion 118. A portion of cord sleeve 140 is inside of rear handle portion 1112 of rear housing 114 to connect cord sleeve 140 to rear housing 114.

Figure 8:
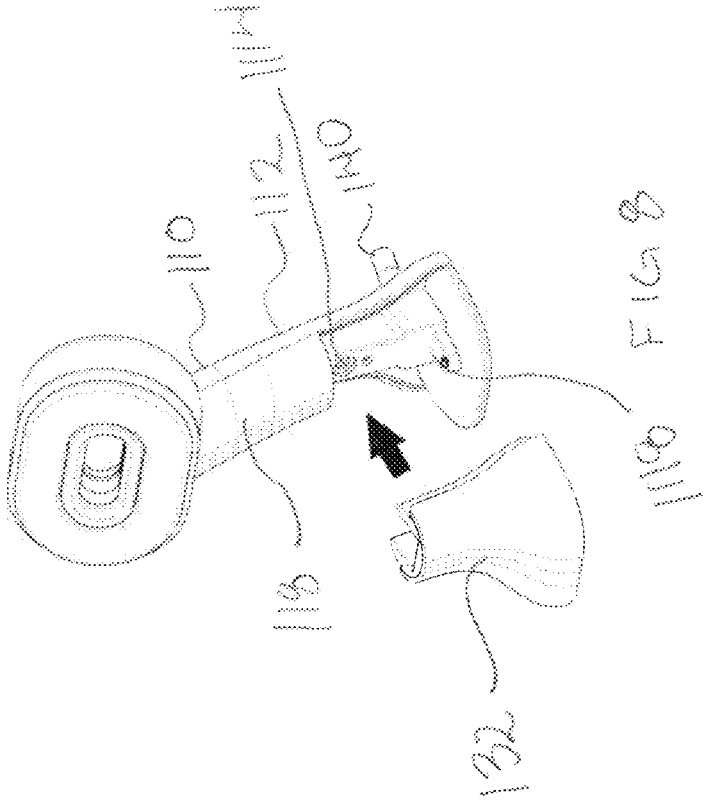
FIG. 8 is a front perspective view of a water tank separated from a remainder of the fabric steamer of FIG. 1.

Referring to FIGS. 3, 4 and 8, water tank 132 has an interior volume 142 and has a connector 144 that connects to an opening 1114 in rear handle portion 1112. Connector 144 has a conduit 146 that connects to tubes 148. Water in water tank 132 can pass through tubes 148 into conduit 146. Conduit 146 removably connects with an opening 1114 in front handle portion 118 so that the water from water tank 132 can flow into front handle portion 118 when conduit 146 is connected to opening 1114. Front handle portion 118 has protrusion 1118 that is spring loaded. Water tank has a depression 1116 that receives protrusion 1118 that is spring loaded. Conduit 146 connecting to opening 1114 in front handle portion 118 and depression 1116 that receives protrusion 1118 maintain water tank 132 removably connected to front handle portion 118 of front housing 112. As shown in FIG. 9, water tank 134 has an opening 1120 that is selectively covered and uncovered by a cap 1122. Cap 1122 selectively connects to and disconnects from water tank 134 by friction fit or other securing mechanism. When cap 1122 uncovers opening 1120 water W can be poured into interior volume 142 to be stored in water tank 134.

Figure 5:
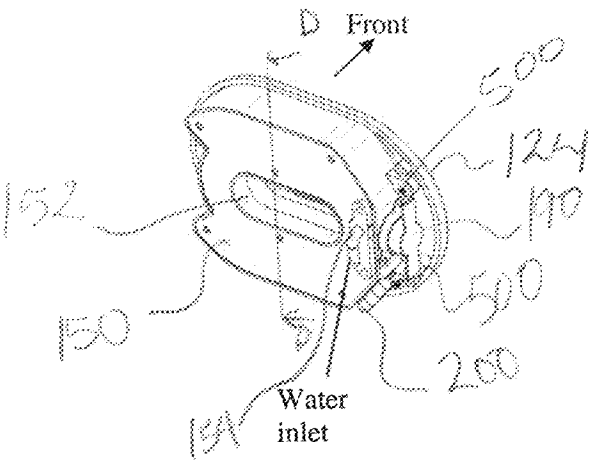
FIG. 5 is a rear perspective view of a steam generator of the fabric steamer of FIG. 1.
Figure 4:
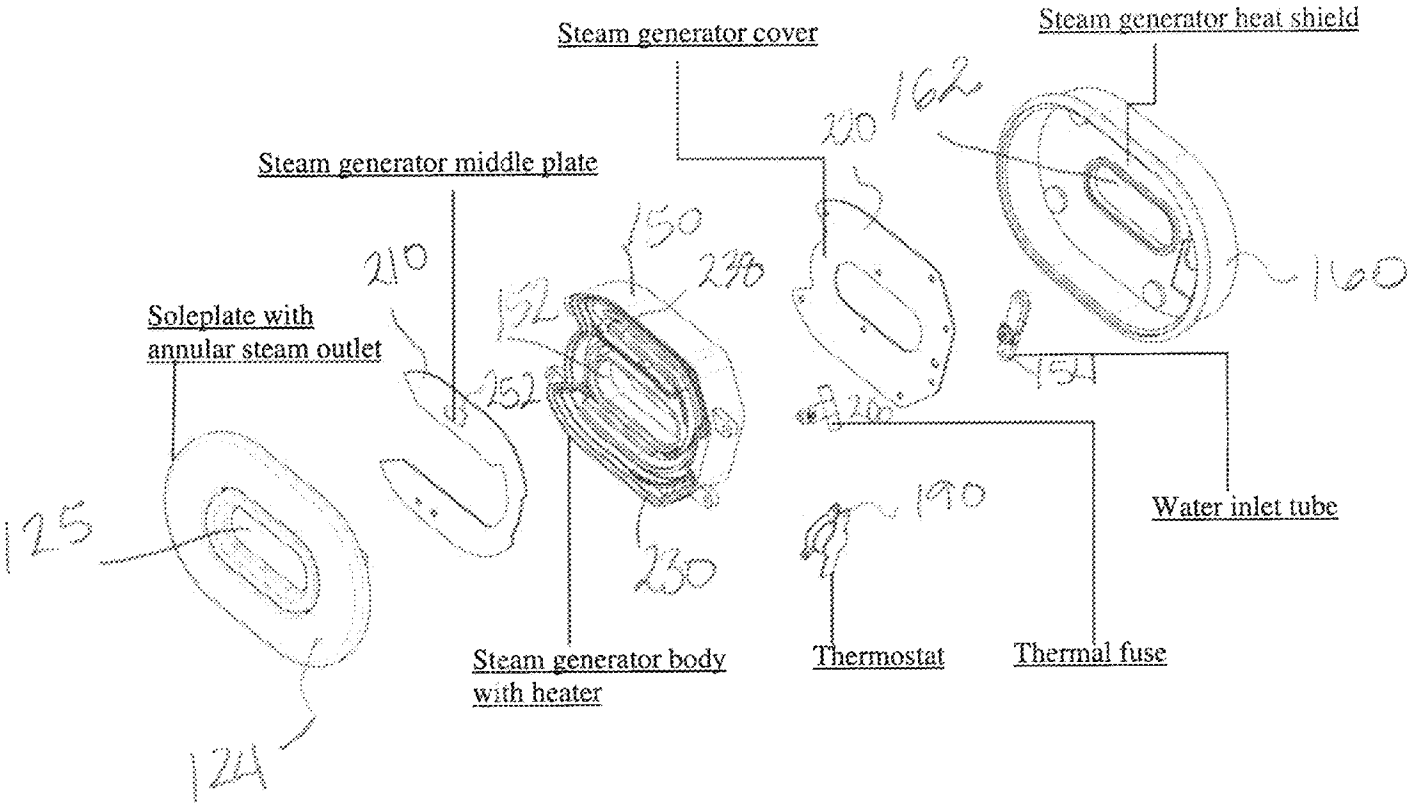

Referring to FIG. 5, steam generator 150 is connected to soleplate 124 by screws 500. Steam generator 150 has a water inlet 154. Steam generator 150 is connected to a thermostat 190 and thermal fuse 200.

Figure 6:
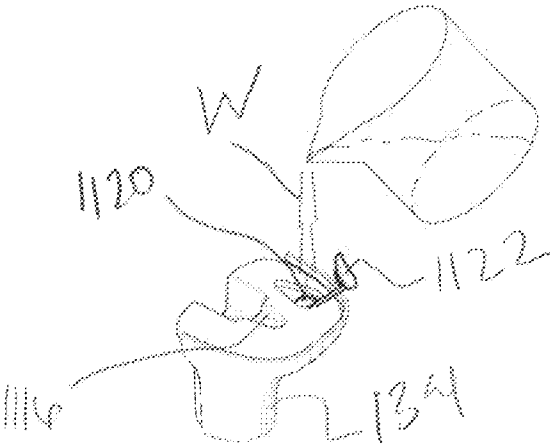
FIG. 6 is an exploded view of the components of the steam generator shown in FIG. 5.

As shown in FIG. 6, when assembled, a steam generator middle plate 210 is between soleplate 124 and steam generator 150. Steam generator cover 220 is between steam generator 150 and steam generator heat shield 160 when assembled.

Referring to FIG. 7, soleplate 124 has an inner surface 128 that faces steam generator 150 when assembled. Soleplate 124 has outer walls 1200 and inner walls 1202 that each extend from inner surface 128. Outlet 126 is formed by openings 1204 through inner surface 128. Heater 240 has end terminals 156 and 158 that attach to wires (not shown) for providing electrical energy to heater 240.

Figure 10:
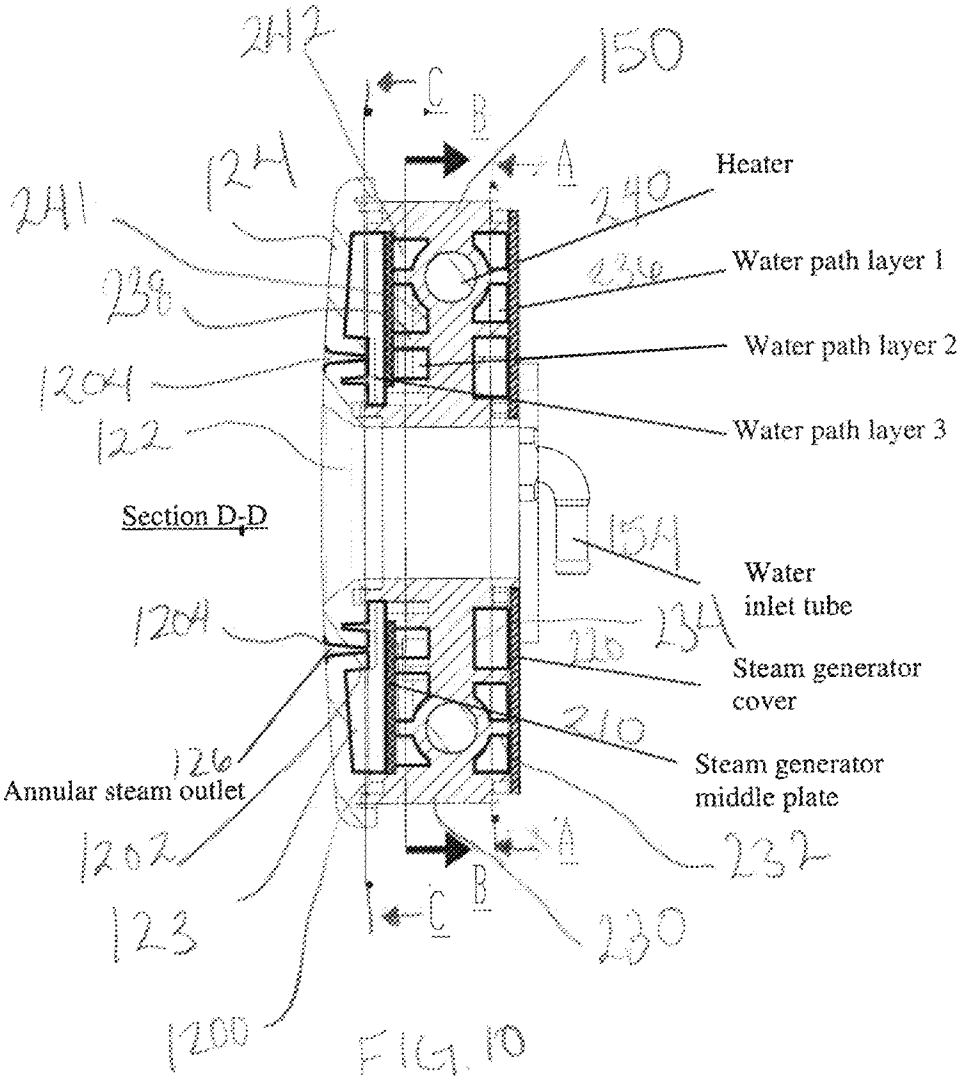
FIG. 10 is a side cross-sectional view of the steam generator taken along line D-D of FIG. 5.

Referring to FIG. 10, steam generator 150 has a body 230 surrounding heater 240. The heater may utilize a tubular electric heater component such as a Calrod® heater. Body 230 has first walls 232 that extend from a first surface 234 of body 230. When steam generator 150 is assembled with steam generator cover 220, a first water path layer 236 is formed between first surface 234, steam generator cover 220 and first walls 232. Referring to FIGS. 6 and 10, body 230 has second walls 238 that extend from a second surface 241 of body 230. When steam generator 150 is assembled with steam generator middle plate 210, a second water path layer 242 is formed between second surface 241, steam generator middle plate 210 and second walls 238. Second water path layer 242 and first water path layer 236 are on opposite sides of heater 240. An inner steam path 123 is also formed by steam generator middle plate 210, inner surface 128 of soleplate 124, and outer walls 1200 and inner walls 1202 that each extend from inner surface 128 of soleplate 124.

Body 230 is a conductive material, for example, metal, to conduct heat from heater 240 to both first water path layer 236 and second water path layer 242. Steam generator middle plate 210 is a conductive material, for example, metal, to conduct heat from second water path layer 242 to inner steam path 123.

Referring back to FIG. 4, in operation, a power cord that is threaded through cord sleeve 140 connects to a power source, for example, an electrical outlet. A user can depress power button 136 to selectively supply power to fabric steamer 100. Light indicator 134 is illuminated when power button 136 is depressed turning on fabric steamer 100 and light indicator 134 is not illuminated when power button 136 is depressed turning fabric steamer 100 off. When fabric steamer 100 is on, power is supplied to circuit board 170, heater 240, pump 180, thermostat 190, thermal fuse 200, and light indicator 134.

The user can press steam trigger 138 to selectively commence emitting steam, for example, to activate pump 180. Pump 180 creates pressure drawing water from water tank 132, through pump 180, and through water inlet 154 into first water path layer 236. Water tank 132 connects to pump 180, for example, by tubing (not shown). Pump 180 connects to water inlet 154, for example, by tubing (not shown).

Figure 11:
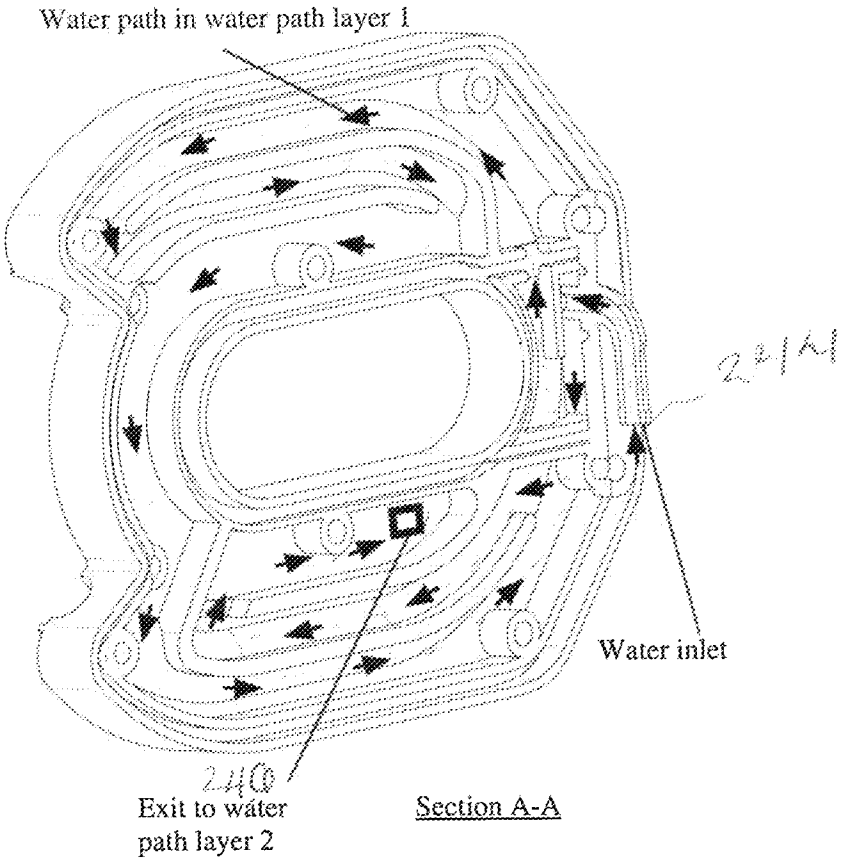
FIG. 11 is a rear cross-sectional view of the steam generator taken along line A-A of FIG. 10.

Referring to FIG. 11, the water flows in first water path layer 236 in a direction as shown by arrows 244 to a first outlet 246 that extends through body 230. The water is heated by heater 240 as it flows along first water path layer 236 in a direction as shown by arrows 244 converting a portion of the water into steam. A predetermined temperature of heater 240 is maintained by thermostat 190 and thermal fuse 200. First outlet 246 extends from first water path layer 236 through body 230 to second water path layer 242 allowing the water and the steam to flow from first water path layer 236 to second water path layer 242.

Figure 12:
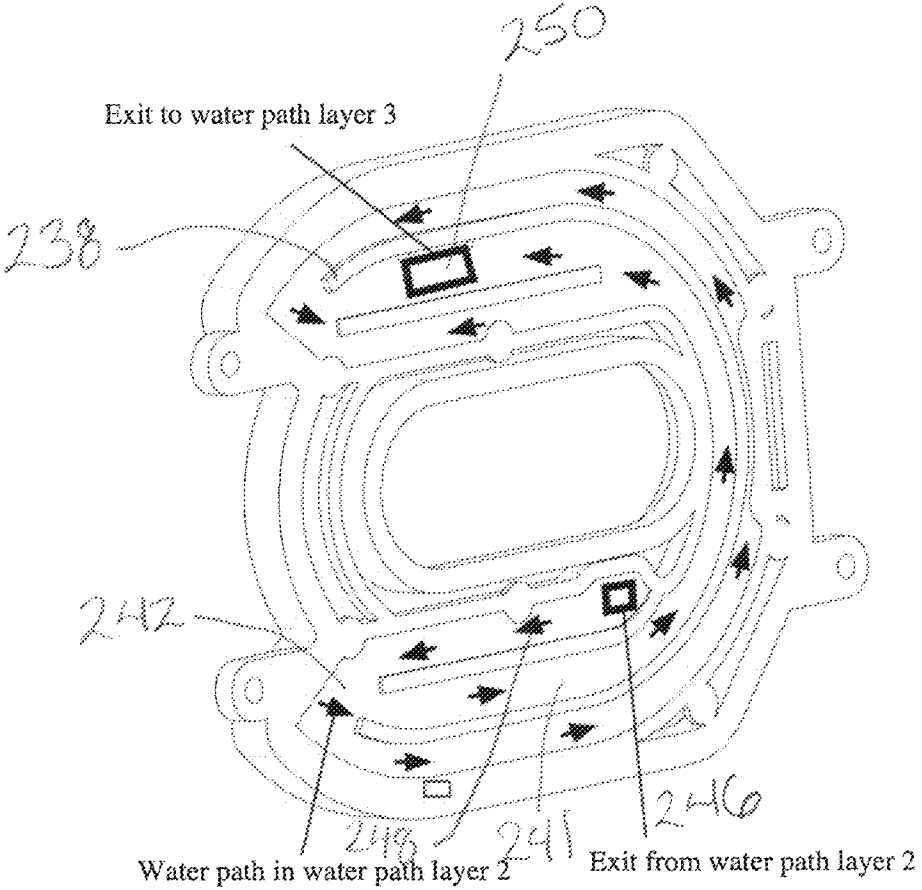
FIG. 12 is a front cross-sectional view of the steam generator taken along line B-B of FIG. 10.

Referring to FIG. 12, the water and the steam flows in second water path layer 242 in a direction as shown by arrows 248 from first outlet 246 to a location 250 of a second outlet 252 that is shown in FIG. 6. The water and the steam in second water path layer 242 is heated as the water and the steam flows in second water path layer 242 in the direction as shown by arrows 248 converting another portion of the water into steam. The water is heated to a higher temperature than in first water path layer 236 and maintains an even distribution of heat over the whole steam generator 150 to avoid hot spots.

Figure 13:
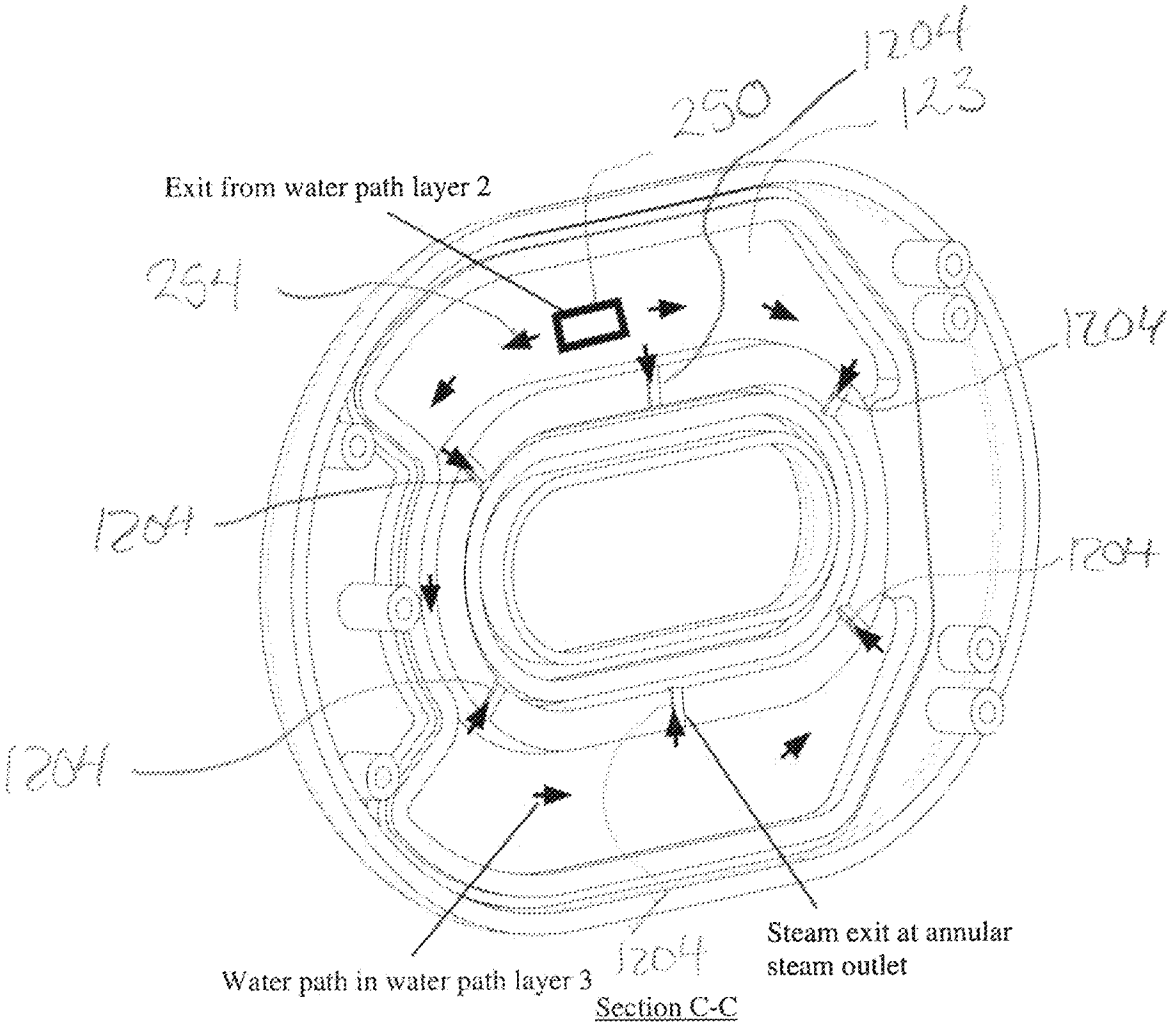
FIG. 13 is a rear cross-sectional view of the steam generator taken along line C-C of FIG. 10.

Referring to FIG. 13, location 250 of second outlet 252 extends from second water path layer 242 through steam generator middle plate 210 to inner steam path 123. The water and the steam in inner steam path 123 flows in a direction as shown by arrows 254 to heat additional water to steam which flows to all openings 1204 of outlet 126 to be distributed out of fabric steamer 100. The three layer water/steam path improves steam generating efficiency and minimizes water spitting during use in different usage orientation. A heater in a conventional steam generator is located on one side of the device and a water path is only a single layer on the one side. The fabric steamer 100 has first water path layer 236 and second water path layer 242 to surround heater 240 on both sides to help the water absorb heat and improve steam generating efficiency. The user can press steam trigger 138 to selectively stop emitting steam by, for example, deactivating pump 180.

Figure 15:
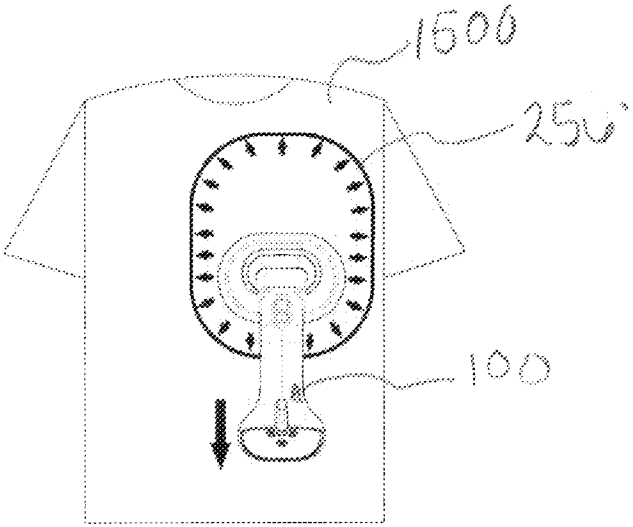
FIG. 15 is schematic illustration of the steam output of the fabric steamer of FIG. 1 on a shirt.
Figure 14:
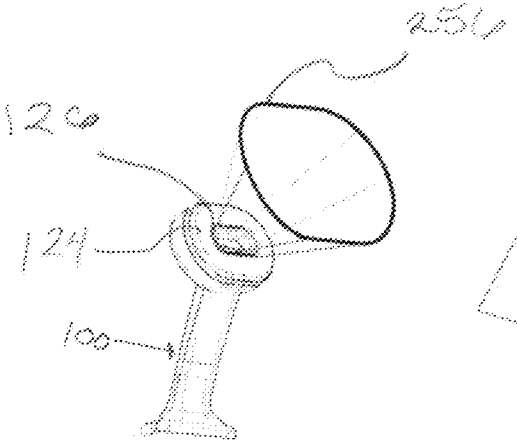
FIG. 14 is schematic illustration of a steam output of the fabric steamer of FIG. 1.

Referring to FIGS. 14 and 15, the steam is distributed out of fabric steamer 100 in a three-dimensional shape 256 similar to a horn resulting from the annular shape of outlet 126. The three-dimensional shape 256 can increase the steam ironing coverage area over conventional steamers and further improve steam ironing efficiency. For example, the typical conventional steamer has a steam outlet with a group of holes that each have a dot shape and the typical appliance has a steam outlet that is in a straight line shape. Also, soleplate 124 of fabric steamer 100 has a quick heat up since it is mounted directly on steam generator 150 and inner steam path 123 that also helps with quick heat up of soleplate 124. Soleplate 124 that is heated can contact fabric for ironing.

Figure 16:
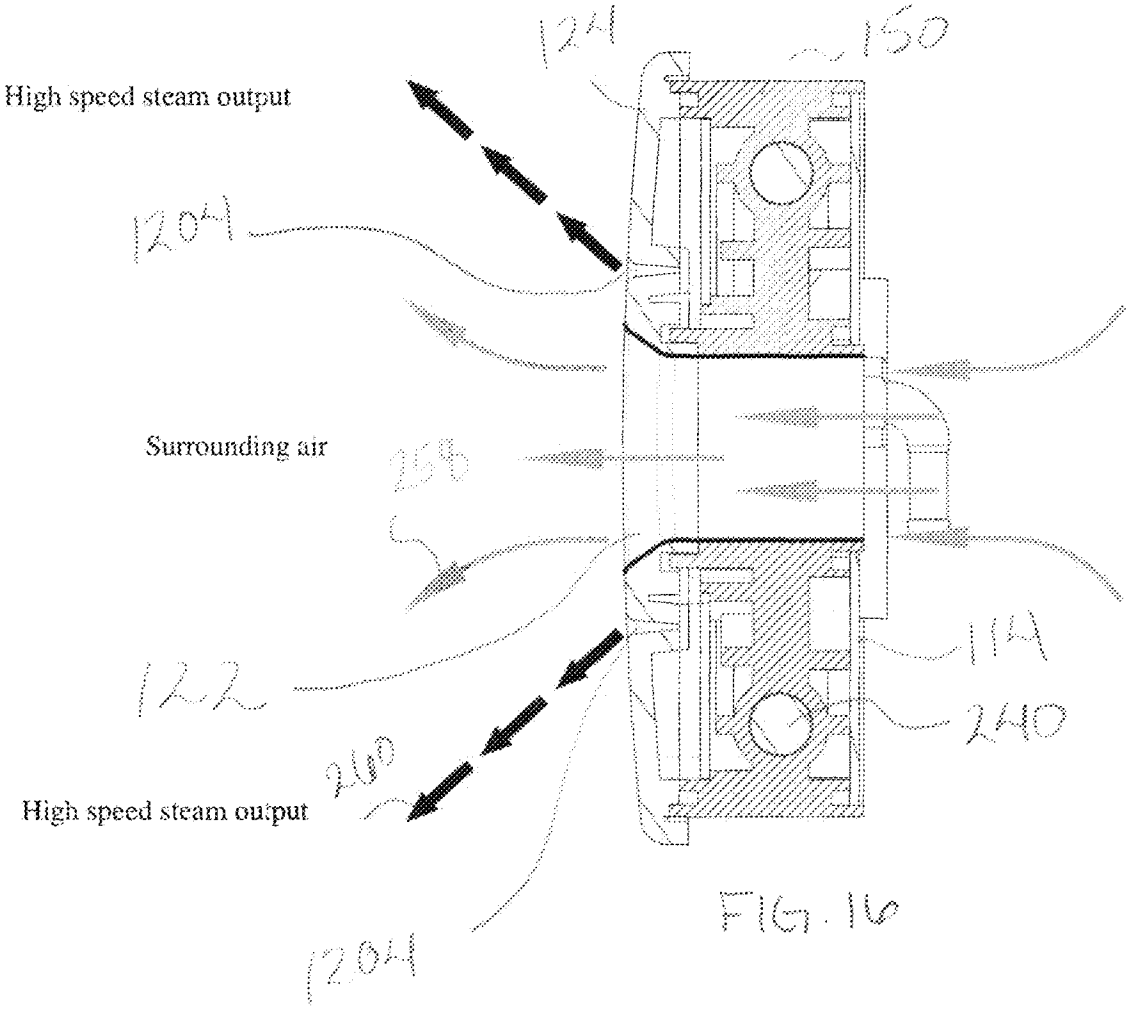
FIG. 16 is a side cross-sectional view of the steam generator taken along line D-D of FIG. 5 that schematically illustrates the steam output of the fabric steamer of FIG. 1 and a flow of surrounding air.

Referring to FIG. 16, surrounding air behind rear housing 114 will be drawn passively to the front of soleplate 124 as shown by arrows 258 through hole 122 when there is active high speed steam output caused by a Venturi effect of surrounding air that is being drawing through by the steam output. The steam emitted from outlet 126 as shown by arrows 260 will mix with the air that is drawn as shown by arrows 258 and reduce a temperature of the steam to make the steam more visible to the user. Accordingly, a steam output speed can be controlled to adjust steam temperature, steam visibility, and volume of steam/air mixture.

Housing 110 has annular steam head 120 with an annular shape forming hole 122 through housing 110 that provides a unique steamer design which can let the user see through to the steam area through hole 122. This see through is a more direct way to monitor steam ironing status, such as, whether the fabric is de-wrinkled or not. Conventional steamers/irons do not have a center hole design due to the limitations on steam generator design. Further, hole 122 reduces an internal volume of annular steam head 120 that results in high pressure steam output as opposed to a larger volume cavity in an annular steam head without a hole, such as hole 122, that results in lower pressure steam.

Referring to FIGS. 17 and 18, outlet 126 is formed by openings 1204 that have a cross section area that is reduced and leaves a narrow gap for steam to pass through, thus steam output pressure will increase. As the steam output speed is higher, it facilitates contacting surrounding air, thus steam temperature would be relatively lower than an outlet that is shown in FIGS. 19 and 20. Referring to FIGS. 19 and 20, an outlet 1900 that is modified from outlet 126 has a cross section area that is bigger than outlet 126 shown in FIGS. 17 and 18. The continuous outlet can be a continuous opening for steam to pass through. This steam output is mild and cloudy as the steam output has a speed that is lower, and the steam temperature may not be affected much by surrounding air, thus keeping a relatively higher steam temperature.

Figures 21, 22, 23:
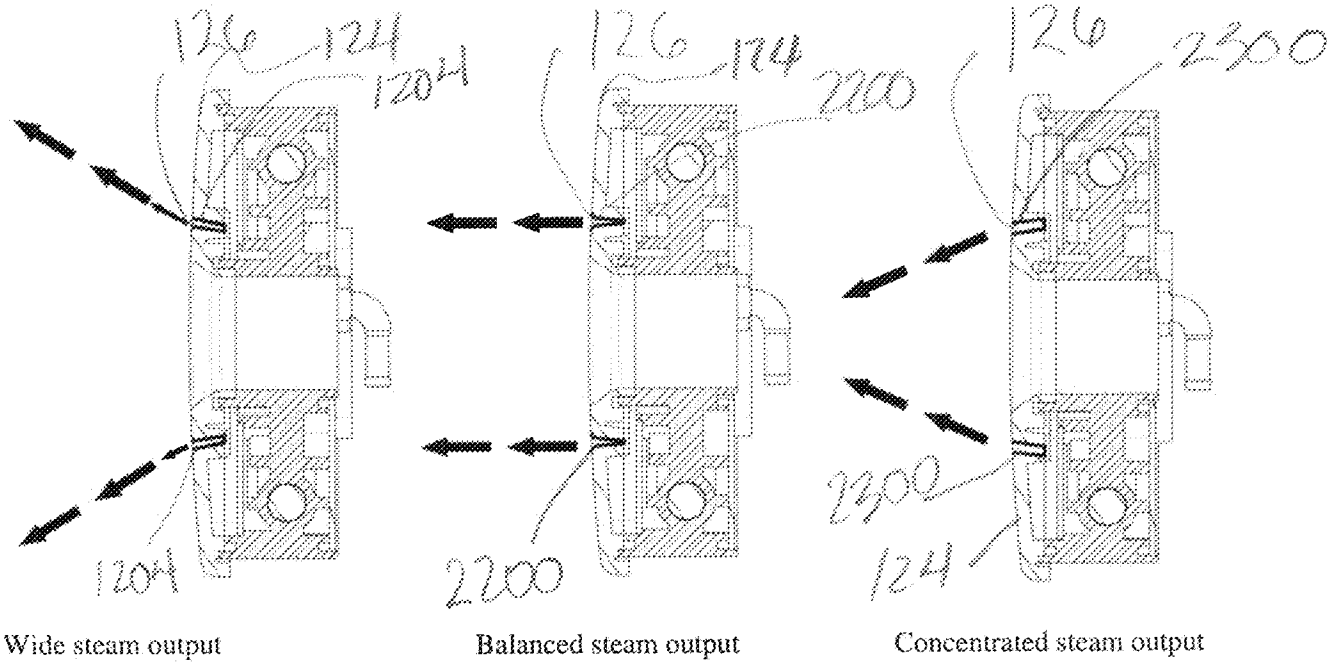
FIG. 21 is a side cross-sectional view of the steam generator taken along line D-D of FIG. 5 that schematically illustrates the steam output of the fabric steamer of FIG. 1 out of the outlet having a first angle.
FIG. 22 is a side cross-sectional view of the steam generator taken along line D-D of FIG. 5 that schematically illustrates an alternative steam output of the fabric steamer of FIG. 1 from an alternative outlet having an alternative angle.
FIG. 23 is a side cross-sectional view of the steam generator taken along line D-D of FIG. 5 that schematically illustrates another alternative steam output of the fabric steamer of FIG. 1 from another alternative outlet having another alternative angle.

Referring to FIGS. 21-23, openings 1204 of outlet 126 can be modified so that through different angle contour designs, outlet 126 can provide different angles for different steam ironing purposes. Outlet 126 can have openings with different angles built-in soleplate 124 or soleplates 124 having outlets 126 with different angles. Soleplate(s) 124 can be interchangeable so a user can selectively connect and disconnect the different soleplates 124. For example, soleplate 124 of FIG. 21 has openings 1204 with a wide steam output, soleplate 124 of FIG. 22 has openings 2200 modified from openings 1204 with a balanced steam output, and soleplate 124 of FIG. 23 has openings 2300 modified from openings 1204 with a concentrated steam output. Alternatively, annular steam head 120 can be modified to be interchangeable. Annular steam head 120 can have a connector that selectively connects and disconnects to a connector in handle portion 130 of housing 110. The connector has an assembly that connects water inlet 154 and pump 180 and also connects heater 240 to the power supply.

Figures 24, 25, 26:
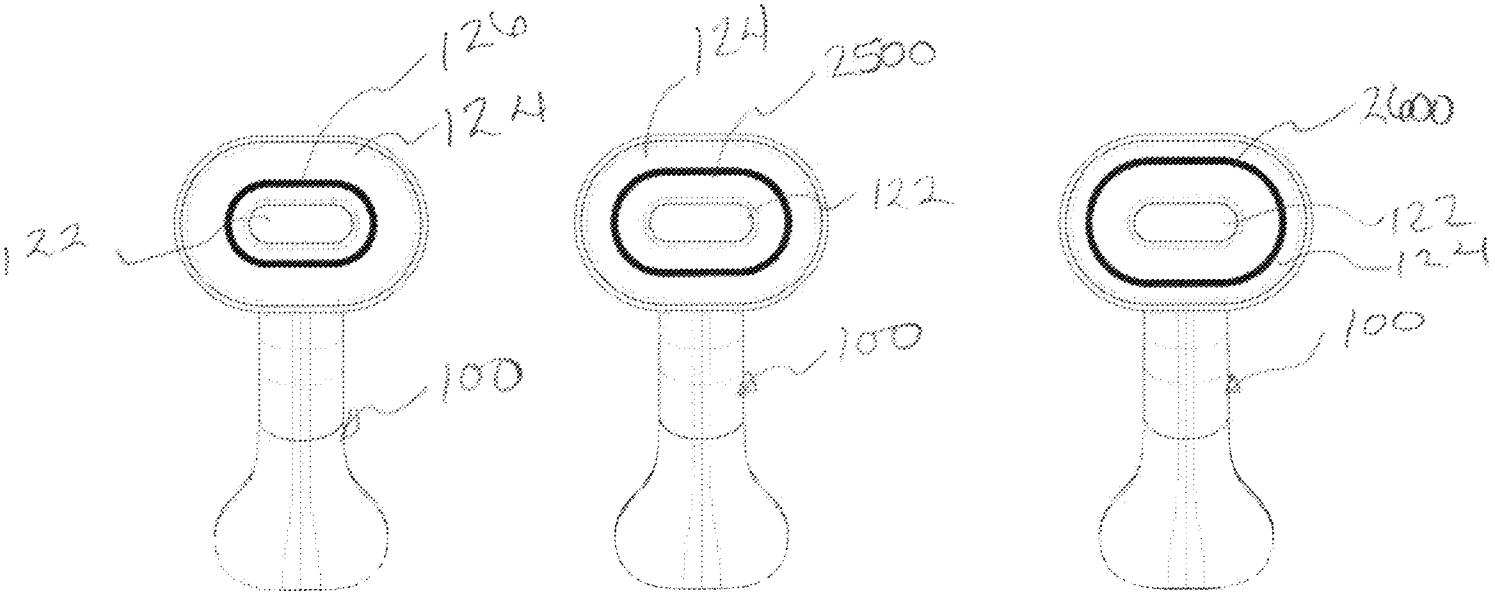
FIG. 24 is a front view of the fabric steamer of FIG. 1 having the outlet with a first position.
FIG. 25 is a front view of the fabric steamer of FIG. 1 having the outlet modified from FIG. 24 so that the outlet is in a second position.
FIG. 26 is a front view of the fabric steamer of FIG. 1 having the outlet modified from FIG. 24 so that the outlet is in a third position.

Referring to FIGS. 24-26, a position of outlet 126 can be modified. FIG. 24 shows outlet 126 that is close to hole 122 so that steam output is more concentrated and facilitates the surrounding air to mix with the steam emitted from outlet 126. FIG. 25 shows outlet 2500 modified from outlet 126 of FIG. 24. Outlet 2500 is positioned in the middle of soleplate 124 so that a balance between wide area steam and concentrated steam is outputted through outlet 126. FIG. 26 shows outlet 2600 that is modified from outlet 126 of FIG. 24 so that outlet 2600 is closer to an outer edge of soleplate 124 to provide wider area steam output.

Figures 27A, 27B, 27C:
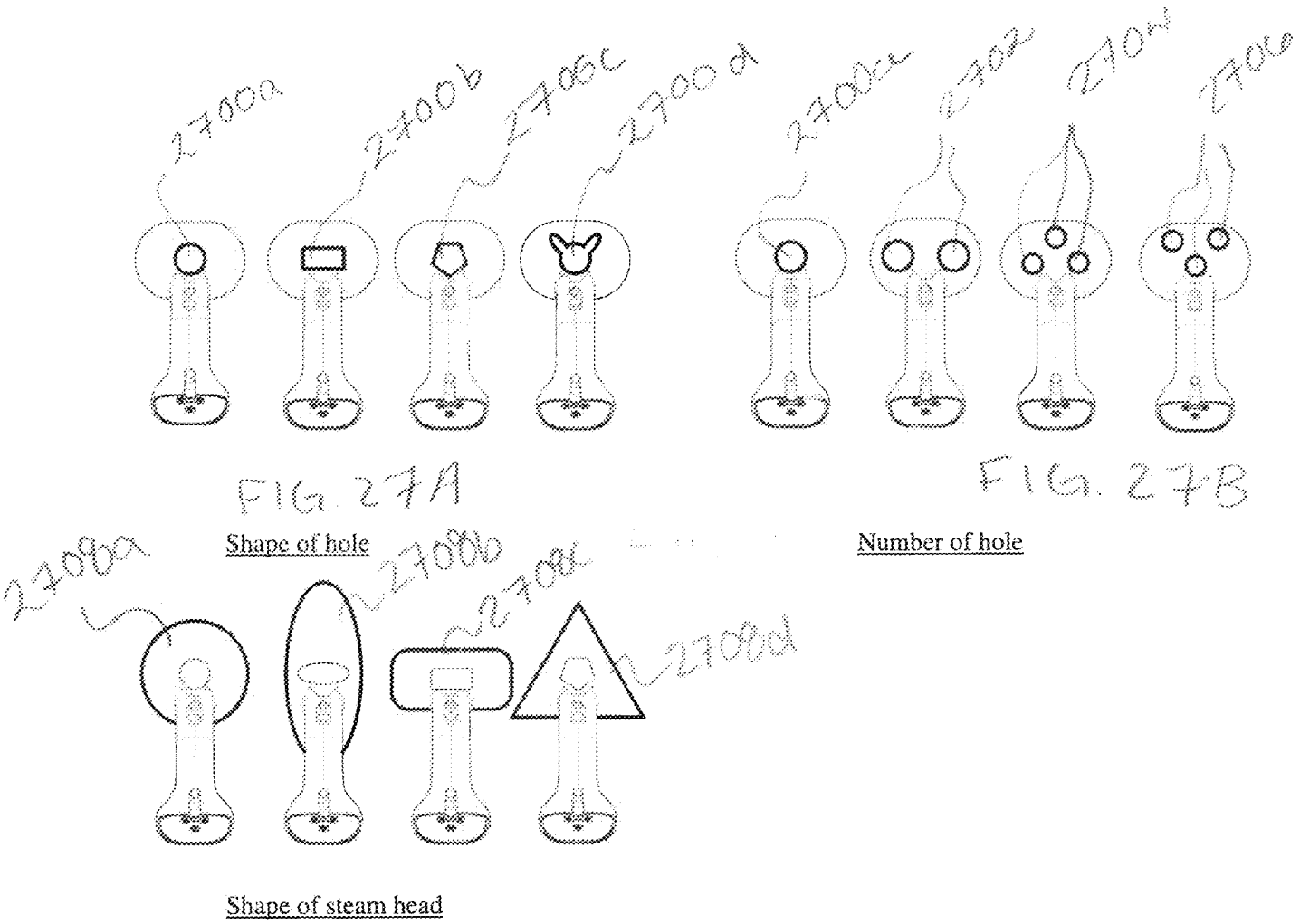
FIG. 27A is a rear view of fabric steamers that each has a hole that is modified from the fabric steamer of FIG. 1.
FIG. 27B is a rear view of fabric steamers that each has a hole or holes that is/are modified from the fabric steamer of FIG. 1.
FIG. 27C is a rear view of fabric steamers that each has a steam head that is modified from the fabric steamer of FIG. 1.
Figure 26:
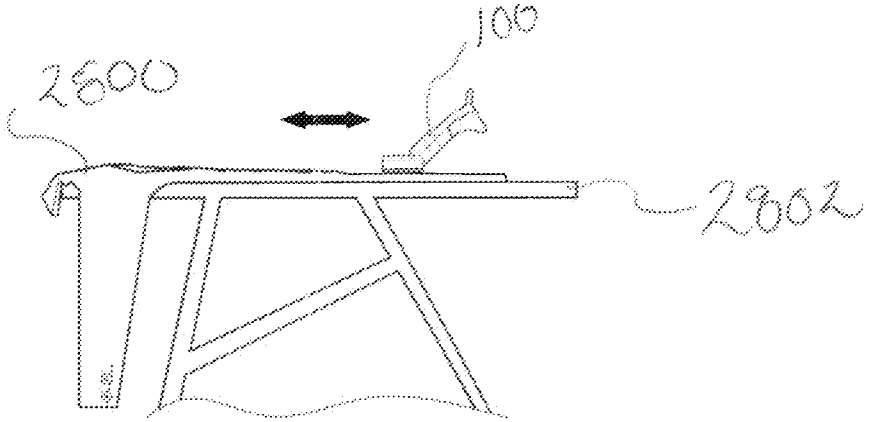

Referring to FIG. 27A, the shape of hole 122 through housing 110 can be modified to a modified hole shape 2700*a-d* that is a different shape than shown in FIG. 1. Fabric steamer 100 has a unique annular form having annular steam head 120 that is hollow. Annular steam head 120 can have any different shape of hole 122, as shown in FIG. 27A. Hole 122 can be any different number of holes as shown by hole 2700*a* and holes 2702, 2704, and 2706 in FIG. 27B. Annular steam head 120 can be modified to a different shape as shown by steam heads 2708*a-d* in FIG. 27C.

Referring to FIG. 28, fabric steamer 100 is capable for use in a horizontal configuration, as shown. In FIG. 28, fabric steamer 100 is in a horizontal orientation for steaming and ironing a shirt 2800 that is supported on an ironing table 2802. Fabric steamer 100 is capable for use in a vertical configuration, as shown in FIG. 15, where fabric steamer 100 is in a vertical orientation for steaming and ironing a shirt 1500 that is supported in a vertical orientation. Handle portion 130 of fabric steamer 100 has a design that is ergonomic for holding by the user in the horizontal orientation and the vertical orientation.

Figure 30:
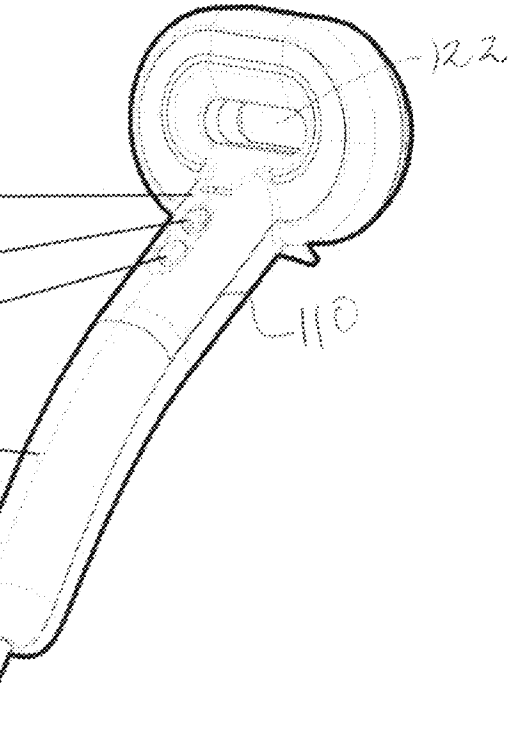
FIG. 30 is a rear perspective view of the fabric steamer of FIG. 29.
Figure 29:
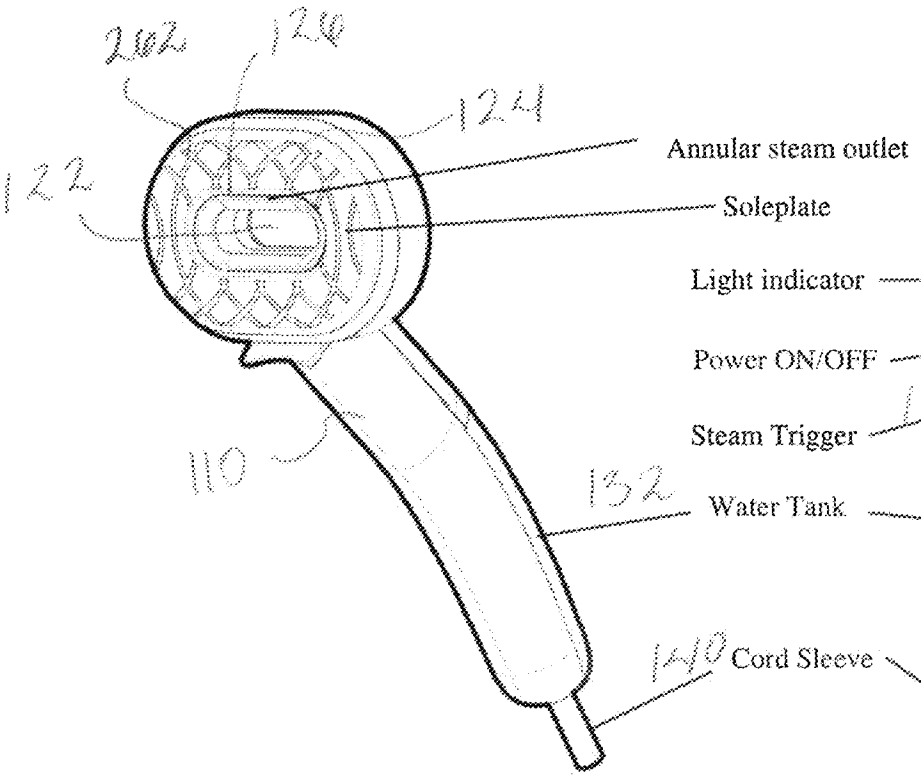
FIG. 29 is a front perspective view of a fabric steamer according to the present disclosure that is modified from FIG. 1.
Figure 32:
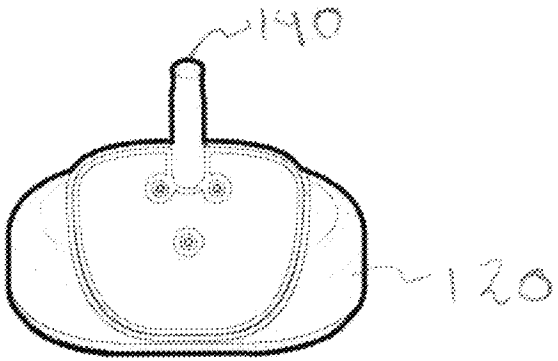
FIG. 32 is a bottom view of the fabric steamer of FIG. 1.
Figure 31:
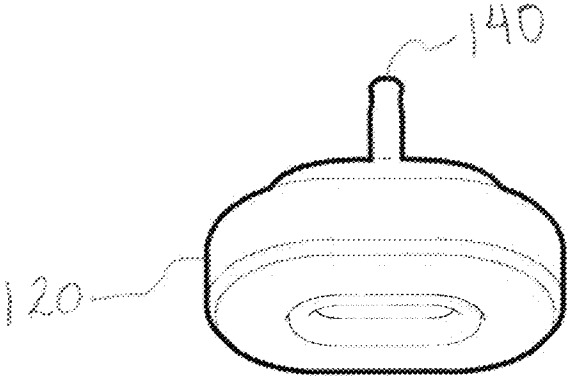
FIG. 31 is a top view of the fabric steamer of FIG. 1.

Referring to FIGS. 29 and 30, water tank 132 and housing 110 can be modified so that they are not shaped to form the stand that supports fabric steamer 100 to rest on the horizontal surface and maintain the vertical orientation as shown in FIGS. 1 and 2. Instead, handle portion 130 and water tank 132 can be shaped for gripping by the user as shown in FIGS. 29 and 30. As shown in FIG. 29, soleplate 124 can also have a different surface texture 262 than that shown in FIG. 1.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the present disclosure will include all aspects falling within the scope of a fair reading of appended claims.

What is claimed is:

1. A handheld appliance for emitting steam to treat a fabric, the appliance comprising:

a housing having a water reservoir, a pump, and a steam generator operatively connected to the pump;

a steam emitting head attached to the housing, the steam emitting head having a front side and a rear side, and a center hole extending through the steam emitting head from said front side to said rear side;

a steam outlet formed on the steam emitting head and surrounding the center hole so that steam inside the steam emitting head is emitted out of the steam outlet.

2. The appliance of claim 1, wherein the steam emitting head and the outlet have an annular shape.

3. The appliance of claim 1, wherein the steam emitting head has a soleplate surrounding the center hole.

4. The appliance of claim 1, wherein the soleplate has a front side and a rear side, and a soleplate hole passing through the soleplate hole from its front side to its rear side, and wherein said soleplate hole generally aligns with said center hole.

5. The appliance of claim 3, wherein the housing has a handle portion that houses the water reservoir.

6. The appliance of claim 3, wherein the soleplate is a first soleplate and the outlet is a first outlet with a first angle through the first soleplate and further comprising a second soleplate having a second outlet with a second angle so that the first angle and the second angle form different steam output angles, and wherein the first soleplate is removable so that the first soleplate and the second soleplate are interchangeable.

7. The appliance of claim 3, wherein the soleplate is a first soleplate and the outlet is a first outlet through the first soleplate with a first configuration and further comprising a second soleplate having a second outlet with a second configuration, and wherein the first soleplate is removable so that the first soleplate and the second soleplate are interchangeable.

8. The appliance of claim 5, wherein the handle forms a stand that supports the housing in a vertical orientation.

9. The appliance of claim 1, wherein the outlet is a continuous, single opening.

10. The appliance of claim 1, wherein the outlet comprises a plurality of openings.

11. The appliance of claim 1, wherein the center hole formed through the steam emitting head is a first hole, and further comprising a second hole formed through the steam emitting head.

12. The appliance of claim 1, wherein the steam generator has a generally annular shape and fits inside the steam emitting head.

13. A handheld appliance for emitting steam to treat a fabric, the appliance comprising:

a housing having a water reservoir, a pump, a steam generator operatively connected to the pump, and a steam emitting outlet, the steam generator forming a steam path having a first layer that extends from an inlet into the steam generator on a first side of a heater to a second layer that is on a second side of the heater opposite to the first layer, the steam generator having a steam generator body connected to a cover on a first side forming the first layer and connected to a plate on a second side that is opposite the first side forming the second layer; and a soleplate that connects to the steam generator on the second side to form a third layer of the steam path that heats the soleplate, the third layer being between the plate and the soleplate, wherein the steam path extends from the second layer to the third layer, and wherein the third layer extends from the second layer to the steam emitting outlet.

14. The appliance of claim 13, wherein the heater is controlled by a thermal controller.

* * * * *